US005212328A

United States Patent [19]

Petrovich

[11] Patent Number: 5,212,328

[45] Date of Patent: May 18, 1993

[54] NONMETALLIC GUN BARREL

[76] Inventor: Paul A. Petrovich, 11269 Judd Rd., Fowlerville, Mich. 48836

[21] Appl. No.: 774,949

[22] Filed: Oct. 11, 1991

[51] Int. Cl.[5] ..... F41A 21/04

[52] U.S. Cl. ..... 42/76.02; 42/78; 89/16

[58] Field of Search ..... 89/16, 15, 14.05, 14.1; 42/76.02, 78, 76.01; 48/76.01

[56] References Cited

U.S. PATENT DOCUMENTS

| | | | |
|---|---|---|---|
| 2,499,944 | 3/1950 | Brace et al. | 89/16 |
| 2,534,811 | 12/1950 | Corlett, Jr. | 42/76.02 |
| 3,517,585 | 6/1970 | Slade | 89/16 |
| 3,571,962 | 3/1971 | Eig | 89/16 |
| 3,641,870 | 2/1972 | Eig | 89/15 |

FOREIGN PATENT DOCUMENTS

| | | | |
|---|---|---|---|
| 186434 | 3/1906 | Fed. Rep. of Germany | 42/78 |
| 463769 | 8/1928 | Fed. Rep. of Germany | 42/78 |
| 621348 | 5/1927 | France | 89/16 |
| 595160 | 6/1959 | Italy | 42/76.01 |
| 107732 | 6/1943 | Sweden | 89/16 |
| 679570 | 9/1952 | United Kingdom | 42/76.02 |

*Primary Examiner*—Stephen M. Johnson

*Attorney, Agent, or Firm*—Peter A. Taucher; David L. Kuhn

[57] ABSTRACT

The invention is a nonmetallic gun barrel having a a longitudinally rigid tubular exterior capable of radial elastic deformation upon passage of a projectile therethrough. Liner segments fixed at the inner diameter of the barrel exterior are abutted end to end and form spiraled rifling structures comprised of shallow channels and ridges between the channels. Radial gaps between sides of the liners can be partly filled by radial projections of elastomeric material of the barrel exterior. The radial projections expand inwardly to seal against a projectile bearing against the inner periphery of the barrel as the projectile is fired from the barrel.

17 Claims, 5 Drawing Sheets

NONMETALLIC GUN BARREL

GOVERNMENT USE

The invention described herein may be manufactured, used and licensed by or for the U.S. Government for governmental purposes without payment to me of any royalty thereon.

BACKGROUND AND SUMMARY

In recent times plastic hand guns and small caliber, high pressure rifles are in some cases a viable alternative to the more traditional metal guns, the chief advantages of plastic guns being their low cost and light weight. However, the barrels of such guns can withstand only a limited number of firings before barrel wear renders the gun essentially useless. Additionally, the typical lack of longitudinal barrel stiffness limits the range and accuracy of such guns.

My invention is a composite, nonmetallic gun barrel which addresses the above problems. My gun barrel includes a tubular exterior and includes a hard inner liner to improve the wear resistance and longitudinal rigidity of the barrel. The liner is divided axially and circumferentially into liner segments to allow local elastic deformation of the barrel as a projectile is fired therethrough. The segments define spiralled channels and ridges for imparting spin to the projectile. Radial gaps between the segments contain elastomeric bodies that seal with a passing projectile to prevent escape of propellant gasses forward past the projectile.

DETAILED DESCRIPTION

Figure 1:
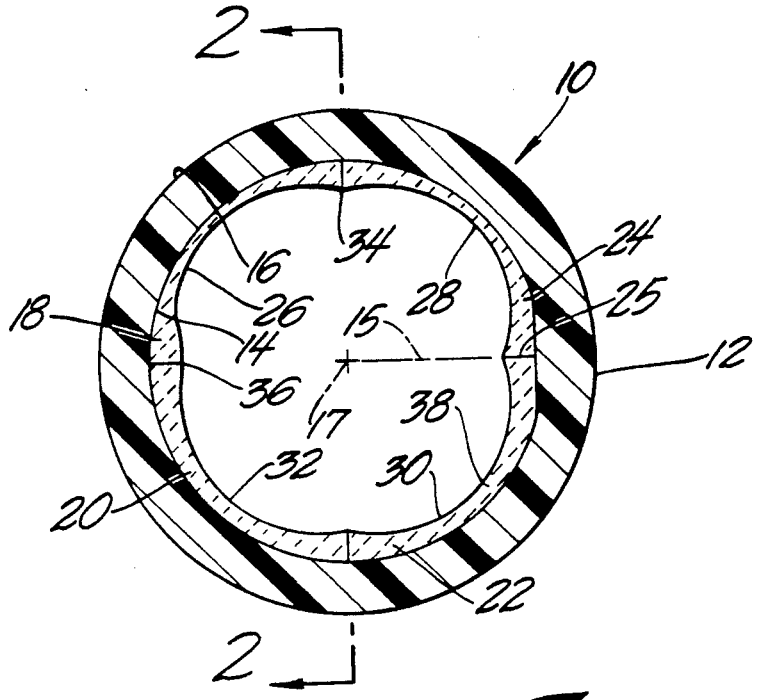
FIG. 1 is a radial cross section of my gun barrel.
Figure 2:
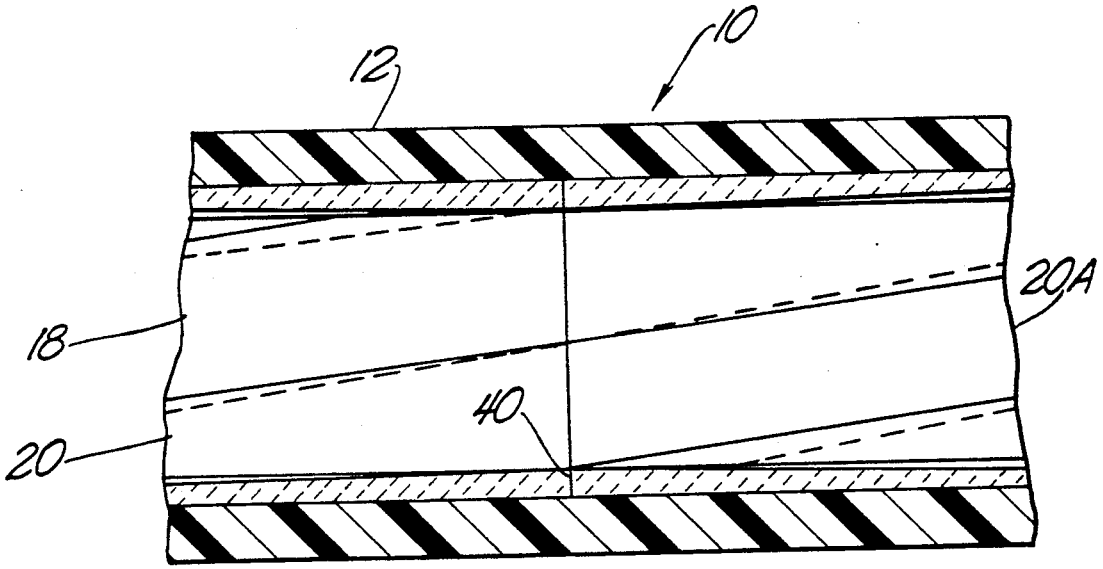
FIG. 2 is a view taken along line 2—2 in FIG. 1.
Figure 3:
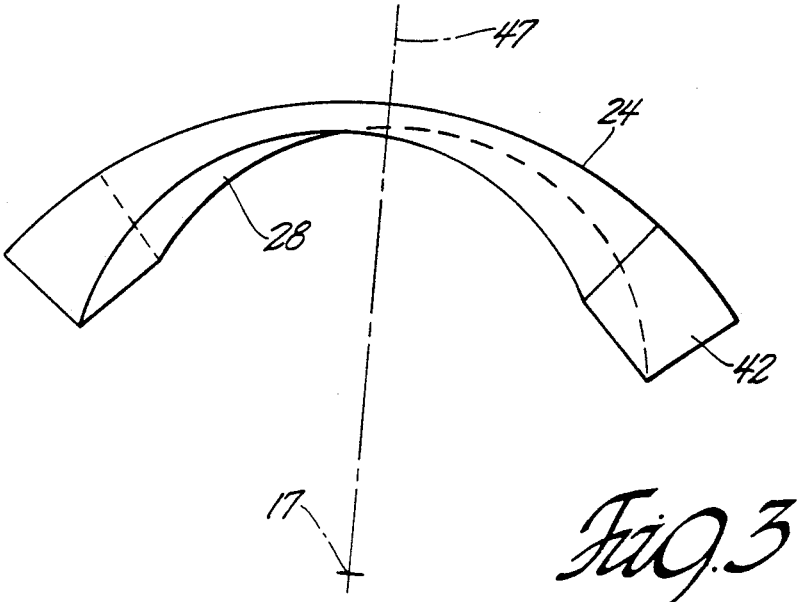
FIG. 3 is an end elevational view of a liner segment shown in FIGS. 1 and 2.

FIGS. 1 and 2 show a first embodiment of my gun barrel 10 wherein tubular barrel exterior 12 comprises a reinforced thermosetting plastic resin. The plastic can be, for example, nylon reinforced with glass, carbon or ceramic fibers. Such a nylon would typically have an elastic modulus of flexure of 1.600,000 psi. a compressive yeild strength of 30,000 psi, and a Rockwell "A" hardness between 65 and 75. The plastic may also be a reinforced polycarbonate resin or an epoxy.

The barrel exterior's inner diameter 14 has a circular cross section concentric with the exterior's outer diameter 16 as shown in FIG. 1. Bonded to inner diameter 14 are ceramic liner segments such as those shown at 18. 20. 22 and 24, the liner segments together defining a plurality of shallow spiralled rifling grooves or channels 26, 28, 30 and 32 along the length of barrel 10. The degree of curvature of the inner faces of the liner segments is exaggerated for purposes of illustration in FIGS. 1 through 4. As seen in FIGS. 1 and 2, the liner segments form a smooth continuous surface. The liner segments can alternately be of similar thermosetting resin as the barrel and integral with barrel exterior 12. The segments will be reinforced more than exterior 12, preferably with ceramic particles either not found in exterior 12 or found in less quantity than in exterior 12.

Figure 4:
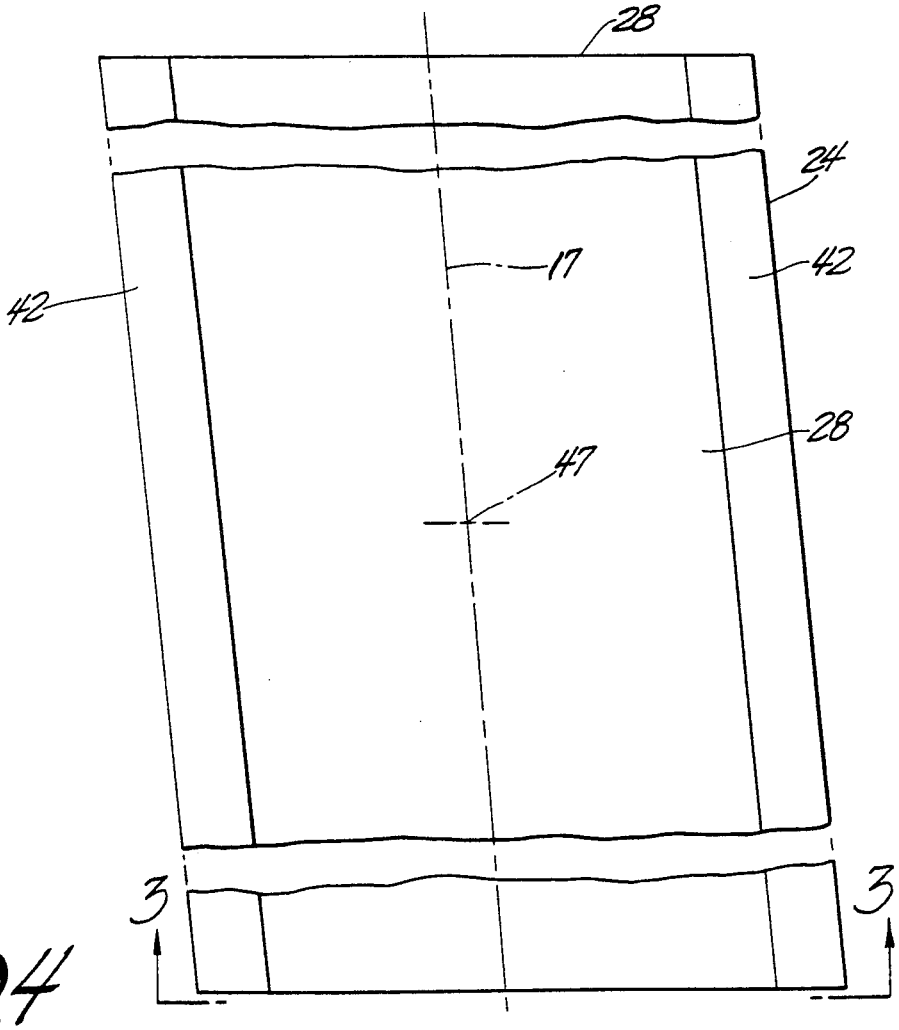
FIG. 4 is another elevational view of the liner segment shown in FIGS. 1 and 2.

It is preferred that the elongate sides of the liner segments be parallel to the channels as illustrated by sides 42 in FIG. 4. It is also preferred that the segments be all of the same curved parallelogram shape shown in FIGS. 3 and 4. Finally, it is preferred that each segment be symmetric with respect to axis 47, which itself radiates from central axis 17 of barrel 10 and passes through the center of volume of segment 28.

The longitudinal edges of the tiles can abut to form sharp ridges as shown at 34 in FIG. 1 or rounded ridges as shown at 36. A zone of the liner segment radially outward of the deepest part of the channels may be thickened by material added at the radially outer side of the liner segment, such as zone 38. Such a modification avoids interfering with the rifling function of the channels while strengthening the liner segment against imbalanced radially outward compression forces exerted by a bullet (not shown in FIGS. 1 through 5) on the barrel when the bullet is fired. Such a modification also adds to the longitudinal stiffness of the barrel. Barrel exterior 12 has sufficient elastic deformabilty to expand radially outward wherever the essentially incompressible liner segments are forced outward by contact with the bullet.

Figure 5:
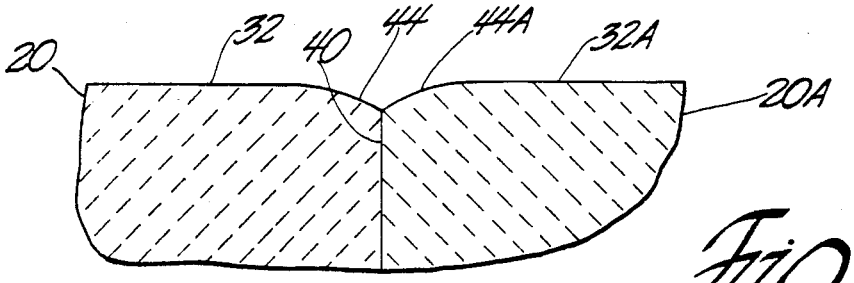
FIG. 5 is a detail view of a circumferential boundary between ends of adjoining liner segments.

FIG. 5 details a typical circumferential boundary 40 between closely fit longitudinally adjacent liner segments 20 and 20A. Rearward corner 44 of segment 20 and forward corner 44A of segment 20A are slightly rounded and together form a small annular groove recessed with respect to aligned inner diametrical surfaces 32 and 32A of the liner segments. The recessed annular groove prevents rearward edge of segment 20 from catching upon the bullet as the bullet is propelled forward in the barrel. It is not strictly necessary that corner 44A be rounded, but it is advantageous to have both the forward and rearward corners of the liner segment rounded, so that either end of any liner segment may face rearward. This versatility simplifies the placement of the liner segments on a mandrel or in a mold prior to molding barrel exterior 12 around the liner segments.

Figure 6:
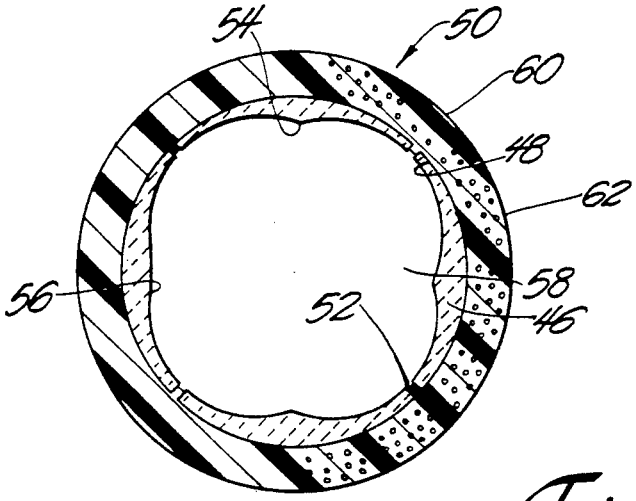
FIG. 6 is a radial cross section of a modified version of my gun barrel.
Figure 8:
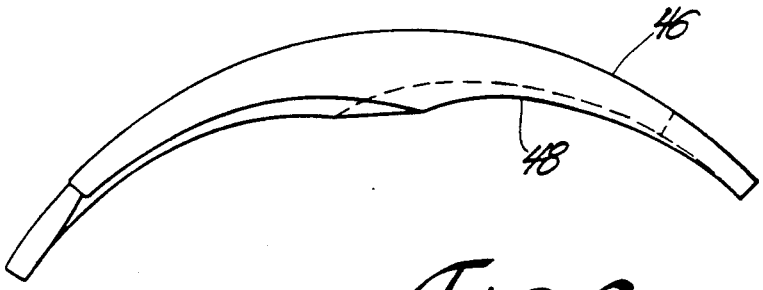
FIG. 8 is an end elevational view of the liner segment shown in FIG. 6.
Figure 9:
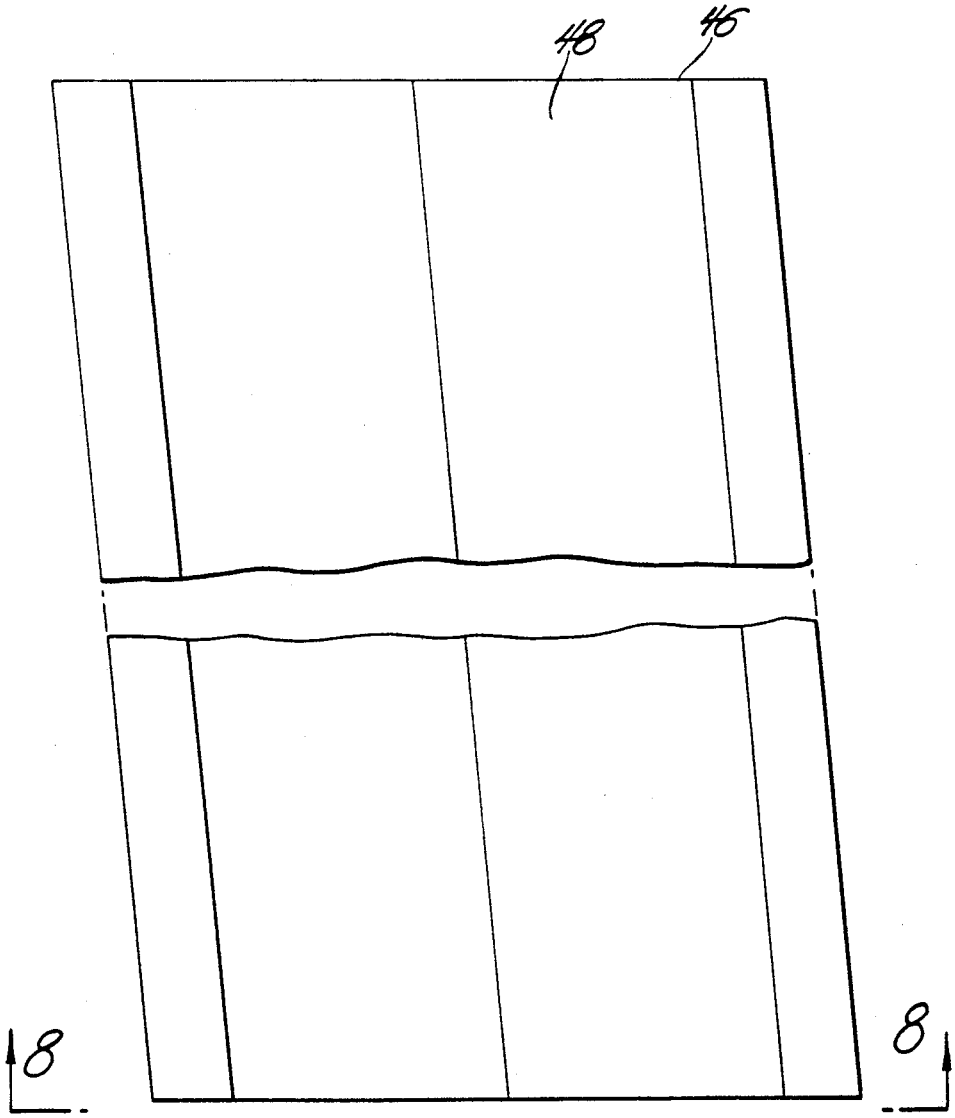
FIG. 9 is another elevational view of the liner segment shown in FIG. 6.

In FIG. 6 is a gun barrel 50 which incorporating modifications that can be made to gun barrel 10. The first modification is to the ceramic liner segments 46, which are also detailed in FIGS. 8 and 9. As with the first embodiment, the liner segments together define a plurality of shallow spiralled rifling grooves or channels, such as channel 48, and the sides of the segments are parallel to the channels. The segments can form sharp ridges 54 or rounded ridges 56. However, the boundaries between longitudinally adjacent liner segments are at the middle of the channels and not at the channel edges as in the first embodiment. As bullet 58 passes through barrel 50 it forces segments 48 radially outward whereby gaps 52 between the segments are formed. Having the longitudinal sides of the segments at deepest part of the channels minimizes the depth of gaps 52 and thus minimizes blow by, or undesired escape, of pressurized propellant behind bullet 58. It is contemplated that bullet 58 will be of a soft metal such as copper or a plastic such as nylon or polytetrafluorethylene.

Another optional feature shown in the right half of FIG. 6 is the presence of longitudinal reinforcing strands or fibers 60 extending the length of the barrel in at least the diametrically outer portion of plastic barrel exterior 62. These fibers would be in addition to other fibers or other reinforcing material in the barrel exterior. The fibers are preferably oriented parallel to the longitudinally axis of the barrel but may be oriented parallel to the channels. The fibers thus add longitudinally stiffness to barrel 50 but permit elastic deformation of barrel exterior 62 in radial or circumferential directions. The diametrically inner portion of barrel exterior 62 may be free of fibers, at least near gaps 52, to insure that a portion of barrel exterior 62 can flow as far as desired into gap 52 when a bullet is fired, as is explained below with reference to FIG. 7.

Figure 7:
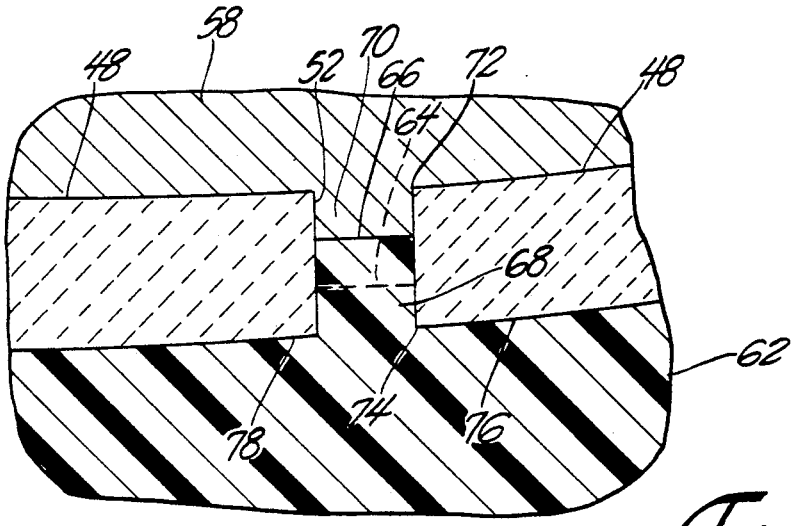
FIG. 7 is a detail view of a radial gap running lengthwise between the sides of neighboring liner segments.

FIG. 7 is a detail view of gap 52 in FIG. 6 wherein the radially outward force of bullet 58 causes an intra gap body 68 of barrel exterior 62 to be squeezed further radially inward into gap 52. Dashed line 64 represents the position of the radially inward face of body 68 in its free state, which exists before bullet 58 presses segments 48 outward to deform barrel exterior 62. Dashed line 64 is intermediate the radially outer end 74 and the radially inner end 72 of of gap 52.

Solid line 66 is the position of body 68 when bullet 68 presses segment 48 outward. Note that a rifling ridge 70 is formed on bullet 58 and that ridge 70 faces against body 68, so that blow by through gap 52 is prevented or at least minimized. Both ridge 70 and gap 52 are much smaller than the rectangularly cross sectioned rifling grooves typical of known gun barrels. The opposed edges of liner segments 48 that form gap 52 will be smooth and will not be bonded to barrel exterior 62, and zones 76 and 78 adjacent the opposed edges will also be smooth and not bonded to the exterior. The smoothness and lack of bonding permits freer movement of intra gap body 68 into and out of gap 52.

Figure 10:
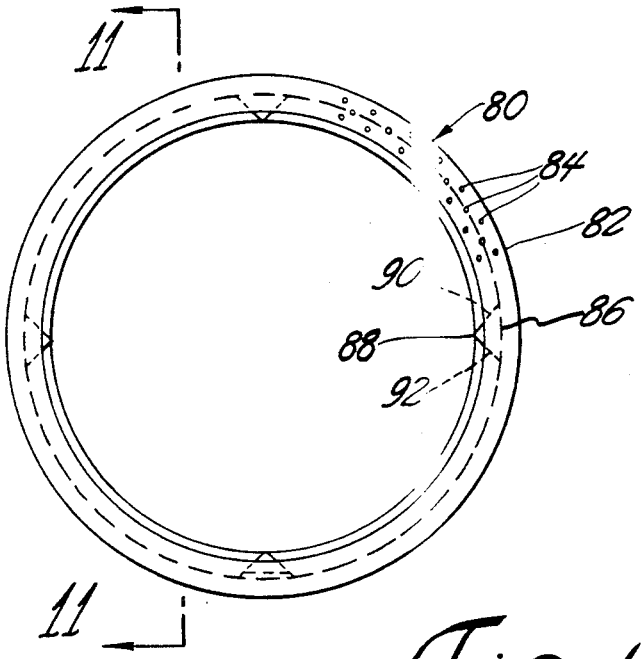
FIG. 10 is an end elevational view of a third embodiment of my nonmetallic gun barrel.
Figure 11:
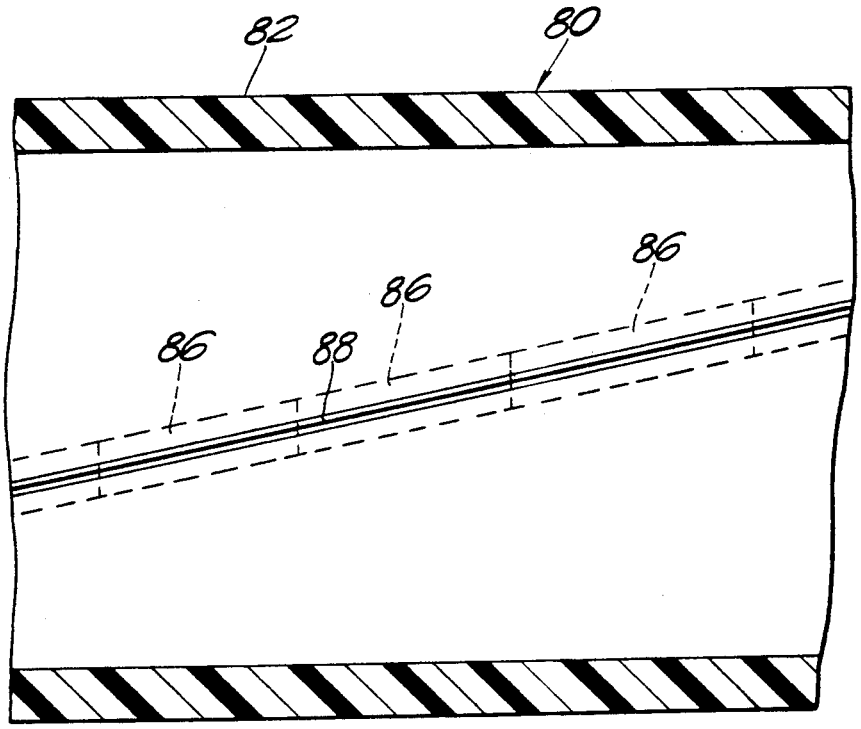
FIG. 11 is a view taken along line 11—11 in FIG. 10.

FIGS. 10 and 11 show a third embodiment of my gun barrel wherein barrel body 82 is made of a longitudinally rigid cylinder of plastic capable of limited radial elastic expansion so as to permit a projectile to be fired therethrough. Optionally barrel body may be reinforced by elongate strands or fibers as shown at 84. Embedded in barrel body 82 are elongate segments 86 aligned end to end whereby the segments form spiral shaped ceramic spines for engraving rifling grooves in the projectile as it passes through the barrel. The circumferential distance between the spines is at least three to four times the circumferential width of the spines.

The spines are triangular or sector-shaped in cross section and have tips 88 projecting radially inwardly from the inner diametrical surface of barrel body 82. The tips are shown as having sharp radially inwardly pointing edges but these edges may be rounded or flattened if desired. It is preferred that the sides 90 and 92 of the spine forming the tips define an included obtuse angle of at least 100 degrees to minimize fracturing of the tips. It is contemplated that the projectile's passage through the barrel will force the spine segments 86 slightly radially outward and elastically deform barrel body 82.

I wish it to be understood that I do not desire to be limited to the exact details of construction shown and described herein since obvious modifications will occur to those skilled in the relevant arts without departing from the spirit and scope of the following claims.

I claim:

1. A nonmetallic gun barrel, comprising:

a barrel axis;

a tubular, elastically deformable barrel exterior portion disposed along the barrel axis and comprised of a thermosetting plastic resin;

a generally cylindrical barrel interior portion divided circumferentially and lengthwise into axial liner segments fixed on an inner diameter of the barrel exterior portion, the liner segments being harder and less compressible than the the barrel exterior portion;

the interior portion defining a plurality of wide, shallow, cross-sectionally curved channels, the channels forming spiral paths about the barrel axis, the channels bounding one another at ridges running along the channels;

wherein the segments have ends between sides, one of the ends on one of the liner segments opposes another of the ends on another of the liner segments, and the one of the ends and the other of the ends together define an arcuate groove at an inner diametrical face of the barrel interior portion.

2. The gun barrel of claim 1 wherein each of the segments comprises an elongate section of one of the channels and each of the channels is comprised of a set of the segments disposed end to end along the barrel.

3. The gun barrel of claim 1 wherein each of the segments includes an elongate section of one of the ridges and each of the ridges is comprised of a set of the segments disposed end to end along the barrel axis.

4. The gun barrel of claim 1 wherein one axial end of one of the segments, opposes another axial end of another of the segments the one and the other axial end being relatively movable.

5. A nonmetallic gun barrel, comprising:

a barrel axis;

a tubular, elastically deformable barrel exterior portion along the barrel axis comprised of a thermosetting plastic resin;

a generally cylindrical barrel interior portion divided circumferentially and lengthwise into axial liner segments fixed on an inner diameter of the barrel exterior portion, the liner segments being harder and less compressible than the the barrel exterior portion;

the interior portion defining a plurality of shallow channels, each of the channels having an axial cross section in the shape of a single smooth continuous curve, the channels forming spiral paths about a longitudinal axis of the barrel, the channels bounding one another at ridges running along the channels.

6. The gun barrel of claim 5 wherein sides of the segments are parallel to the channels and the sides are aligned with radii from the longitudinal axis of the gun barrel.

7. The gun barrel of claim 6 wherein at least two of the segments are selected segments identical to one another, wherein the selected segments are symmetric with respect to second axes extended from the longitudinal axis through volumetric centers of the selected segments.

8. The gun barrel of claim 6 wherein:

the segments have ends connected between the sides; and one of the ends on one of the liner segments is in face to face abutment with another of the ends on another of the liner segments;

the one of the ends of the other of the ends together define an arcuate groove at an inner diametrical face of the barrel interior portion.

9. The gun barrel of claim 5 wherein axial cross sections of the segments and the axial cross sections of the channels span equal chordal widths, and wherein the channels are formed by sets of the segments disposed end to end along the barrel.

10. The gun barrel of claim 5 wherein each one of the segments defines only a single elongate section of one of the ridges and wherein the ridges are formed by sets of the segments disposed end to end along the barrel axis.

11. A gun barrel, comprising:

a circumferentially continuous tubular barrel exterior portion;

a generally cylindrical barrel interior portion divided radially and lengthwise into axial liner segments bounded by and fixed on an inner diameter of the barrel exterior portion, the liner segments being harder and less compressible than the the barrel exterior portion;

the interior portion defining a plurality of channels forming spiral paths about a longitudinal axis of the barrel, the channels bounding one another at ridges running along the channels;

the channels having shallow, dish-like radial cross-sectional profiles wherein radially inner boundaries of the profiles are smooth curves eccentric relative to a longitudinal axis of the gun barrel.

12. The gun barrel of claim 11 wherein each one of the segments has a same chordal dimension in axial cross section as a single elongate section of one of the channels and wherein the channels are formed by sets of the segments disposed end to end in the barrel exterior portion.

13. The gun barrel of claim 11 wherein each one of the segments has a only single elongate section of one of the ridges and wherein the ridges are formed by sets of the segments disposed end to end in the barrel exterior portion.

14. The gun barrel of claim 11 wherein sides of the segments are parallel to the channels and the sides are aligned with radii from the longitudinal axis of the gun barrel.

15. The gun barrel of claim 14 wherein at least two of the segments are selected segments identical to one another, wherein the selected segments are symmetric with respect to second axes extended from the longitudinal axis through volumetric centers of the selected segments.

16. The gun barrel of claim 14 wherein;

the liner segments have ends connected between the sides; and one of the ends on one of the liner segments is in face to face abutment with another of the ends on another of the liner segments;

the one of the ends and the other of the ends together define an arcuate channel at an inner diametrical face of the barrel interior portion.

17. The gun barrel of claim 14 wherein;

the liner segments have ends connected between the sides; and one of the ends on one of the liner segments opposes another of the ends on another of the liner segments;

the one of the ends is mobile relative to the other of the ends.

* * * * *